United States Patent [19]

Rieger et al.

[11] Patent Number: 4,940,183

[45] Date of Patent: Jul. 10, 1990

[54] ARRANGEMENT FOR FASTENING RAILS

[75] Inventors: Johann Rieger; Hermann Orasche, both of Zeltweg, Austria

[73] Assignee: Voest-Alpine Maschinenbau Gesellschaft m.b.H., Linz, Austria

[21] Appl. No.: 346,746

[22] Filed: May 3, 1989

[30] Foreign Application Priority Data

May 10, 1988 [AT] Austria ..... 1231/88

[51] Int. Cl.[5] ..... E01B 9/60

[52] U.S. Cl. ..... 238/310; 238/292; 238/336; 238/349

[58] Field of Search ..... 238/310, 338, 342, 349, 238/337, 336, 292, 293, 281, 284, 282, 283

[56] References Cited

FOREIGN PATENT DOCUMENTS 2230204 4/1973 Fed. Rep. of Germany ..... 238/336

*Primary Examiner*—Andres Kashnikow
*Assistant Examiner*—Mark T. Le
*Attorney, Agent, or Firm*—Cushman, Darby & Cushman

[57] ABSTRACT

In an arrangement for fastening stock rails, wing rails or track rails (1) at the side being averted from the running edge, in which arrangement a strap (5) is pressed against the web of the rail with interposition of a leaf spring (9) or, respectively, of a spring pile, the strap (5) is given a convex shape at its outer side facing the leaf spring (9), whereby a defined pressure point (D) is provided for the attack of the leaf spring (9).

7 Claims, 7 Drawing Sheets

ARRANGEMENT FOR FASTENING RAILS

BACKGROUND OF THE INVENTION

1. Field of the Invention

The invention refers to an arrangement for fastening stock rails, wing rails or track rails at the side averted from the running edge, in which arrangement a strap is pressed against the web of the rail with interposition of a leaf spring or a spring pile, respectively.

2. Description of the Prior Art

From the DE-AS No. 22 30 204, there has already become known an arrangement for fastening rails in which the web of a rail is resiliently pressed against an abutment with interposition of a strap. In the known arrangement, there was used a wedge-shaped clamping member for making sure a laminar pressing action on the strap and simultaneously tensioning the spring pile. Such an outer support is primarily utilized in switch constructions, noting that in more recent constructions there is most frequently preferred an inner elastic clamping over an outer support. An elastic inner clamping of stock rails can always not be used if height differences of the used rails are insufficient. In case of outer supports without using a spring element, the screw coupling must be retightened at regular intervals for preventing the fastening means from becoming worn out. Even when using a spring element, a permanent force-locking connection can never reliably be maintained if the rail webs have exceedingly great tolerances. Such rolling tolerances result in an irregular shape of the fishplate seating and such an irregularity of the fishplate seatings can, in the known constructions, result, in spite of a resilient support, in a differing force distribution over the length of the rail.

SUMMARY OF THE INVENTION

The invention now aims at providing a simple outer support when utilizing a leaf spring or a spring pile, respectively, in which support there can be introduced into the rail defined forces as supporting forces in non-loaded condition of the rails as well as in loaded condition of the rails even in case of greater production-based rolling tolerances and in case of an irregular shape of the fishplate seatings.

For solving this task, the invention is, based on an arrangement of the above-mentioned type, essentially characterized in that the strap is given a convex shape at its outer side facing the leaf spring. On account of the strap having a convex shape at its outer side, there is provided a defined pressure point for the action of the spring and the strap itself is given the possibility to adjust itself in correspondence with the irregularities of the fishplate seating without the result of a substantially variation of the introduced supporting forces. A particularly simple embodiment may be achieved if the outer side of the strap is formed of two surfaces adjoining one another under an obtuse angle.

The leaf spring or leaf spring pile, respectively, can in a particularly advantageous manner be secured in position if the leaf spring or the leaf spring pile, respectively, is supported within a supporting block in a manner preventing shifting in height direction. In this case, the supporting block can be welded onto a ribbed plate or be screwedly connected with the ribbed plate at the other side of the rail, and this supporting block acts as a bearing for the spring element in vertical direction and as an abutment for the spring element in horizontal direction. The spring element is, in this case, introduced between the supporting strap and the supporting block, noting that any variation of the gap width as caused by rolling tolerances can be compensated by fill plates of different thickness. In this case, the construction is advantageously selected such that fill plates are arranged between the strap and the leaf spring, noting that, when using fill plates, a slight pretensioning can be obtained also in case of a non-loaded rail. On account of the convex or blunt-edged, respectively, design of the straps, there results a defined point for introducing the force of the spring element, noting that on account of the convex or, respectively, blunt-edged design of the strap there results in the bearings of the supporting block a corresponding play delimiting bowing underload and thus the maximum spring force. The spring element may be secured in vertical direction by noses provided on the supporting block. For the purpose of permitting the defined limited movement of the strap relative to the supporting block, the design is advantageously selected such that the length of the leaf spring or of the spring pile, respectively, is smaller than the length of the strap and that the strap is screwedly connected with the rail web and the lateral flanges of the supporting block with the maintainance of some play, noting that lateral evading of the leaf spring or spring pile, respectively, in longitudinal direction of the rail can effectively be prevented if the strap is screwedly connected to the lateral flanges of the supporting block with interposition of wedge plates forming an abutment against shifting the leaf spring or leaf spring pile, respectively.

The foot of the rail can be fixed at the travelling side by an abutment on the ribbed base slab. When using screws extending through lateral flanges of the supporting block, the maximum shifting movement can be adjusted by the screwing depth of the nuts. It is however essential, that screwing is effected such that some play remains for the elastic evading movement of the rail, said play being compensated by the spring with progressing supporting force.

Cams cooperating with counterstops on the supporting point or on an anchor plate can also be connected with the strap, so that in this manner the maximum elastic evading path of the rail is limited.

Because the screw connection must also allow shifting movement of the rail in axial direction of the screw bolts, it is necessary to separately secure the nuts against becoming lost, for which purpose there can in a simple manner be provided a security splint. However, the arrangement can alternatively be selected such that the strap or fishplate is screwedly connected with the rail and the supporting block with interposition of spring rings being supported on the rail web and/or on the flange of the supporting block, whereby any impact stress is avoided also within the area of the nuts.

BRIEF DESCRIPTION OF THE DRAWING

In the following, the invention is further explained with reference to examples of embodiment shown in the drawing. In the drawing

DETAILED DESCRIPTION OF THE PREFERRED EMBODIMENTS

Figure 1:
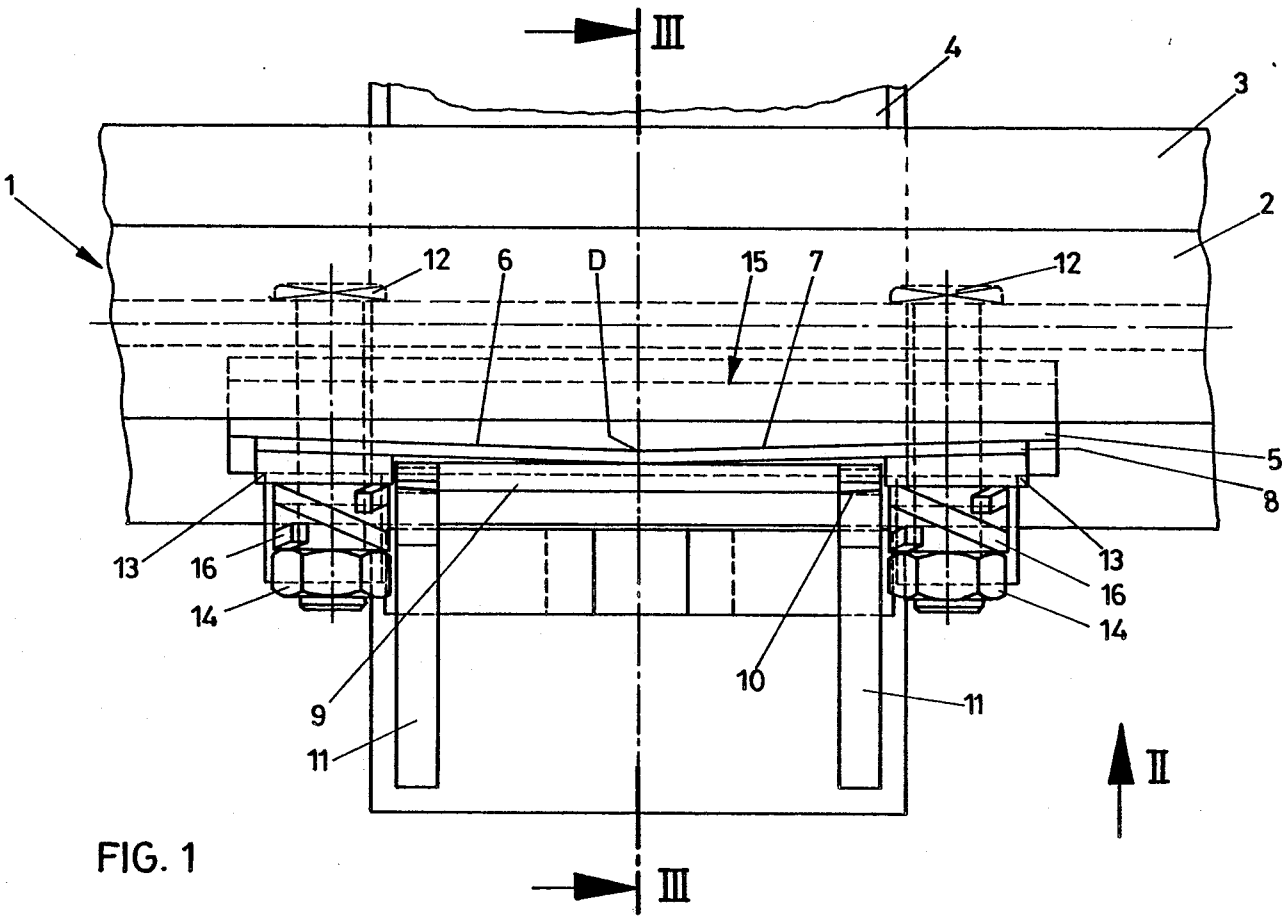
FIG. 1 is a top plan view of a rail comprising an arrangement for fastening rails according to the invention.

In FIG. 1, there is shown a rail 1 comprising a running surface 2 and a rail foot 3 and being fixed on a ribbed plate 4. The rail is fixed in position by means of a strap 5 arranged in the fishplate seating of.±he rail and having at its outer side, for the purpose of forming an outer side of convex shape, two surfaces 6 and 7 adjoining one another under a blunt or obtuse angle. By said surfaces 6 and 7 of the flap or fishplate 5 adjoining one another under a blunt or obtuse angle, there is formed a defined pressure point D cooperating with a leaf spring 9 with interposition of a fill plate 8. The leaf spring is there received in bearings 10 of a supporting block 11. In this case, the supporting block 11 is connected by welding with the ribbed plate or, respectively, a base plate. The elastic fixing of the rail 1 on the supporting block 11 is effected via fill plates and the abutment 20, noting that the whole arrangement is arranged on the outer side of the rail, i.e. on that side of the rail which is averted from the running edge. For the purpose of limiting the shifting path of the leaf spring 9, the strap or fishplate 5 is screwedly mounted with interposition of wedge-shaped plates 13. The screw connection is, in this case, effected by means of screws 12. The number of the fill plates and thus the thickness is selected such that some play remains for the elastic evading movement of the rail 1 in direction of the arrow 15, said play being received by the leaf spring 9 with a progressive supporting force. The maximum evading path is, in this case, limited by stops on the supporting block 11. The nuts 14 are secured in position by spring rings 16.

Figure 2:
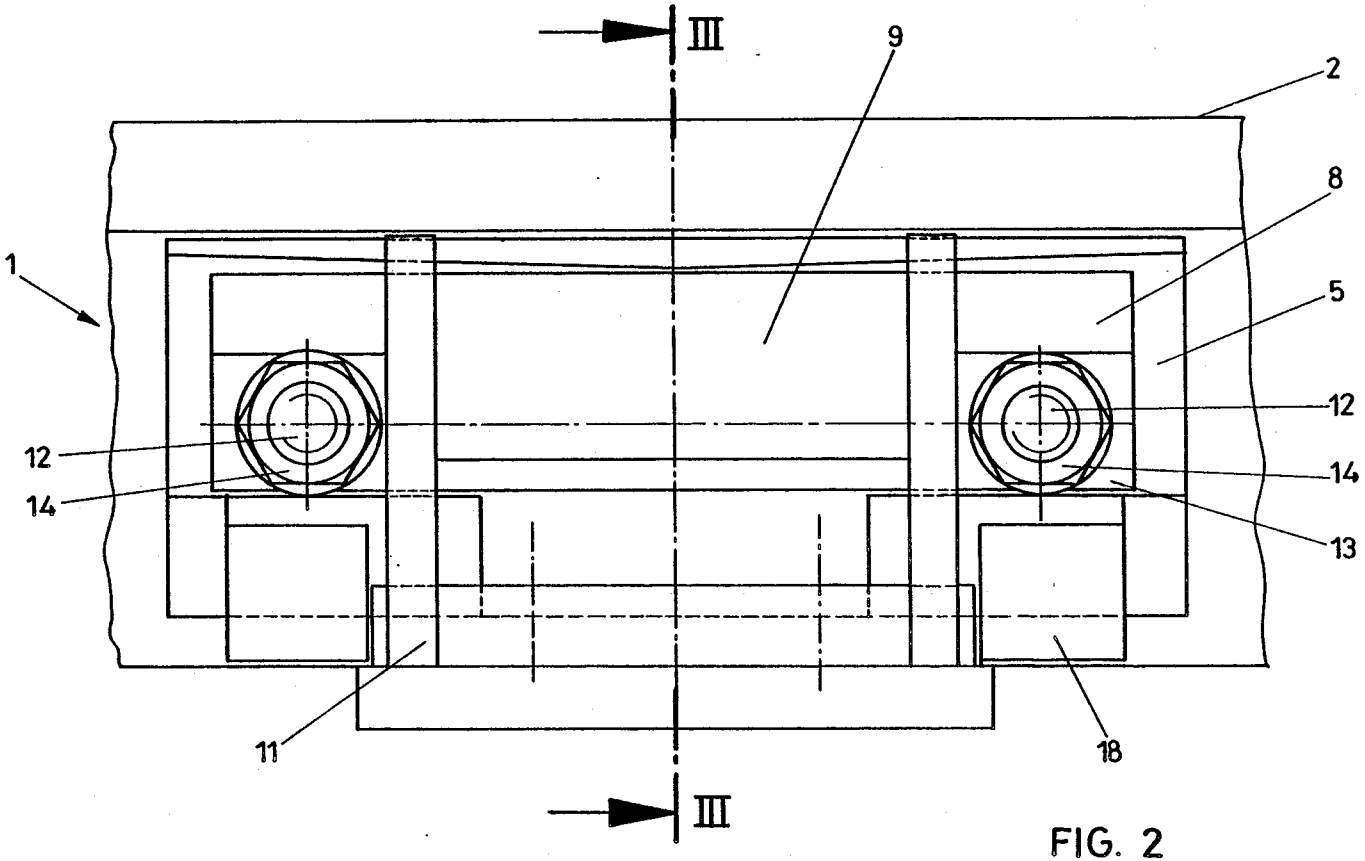
FIG. 2 shows in direction of the arrow II of FIG. 1 a side elevation of the rail comprising the arrangement according to the invention.

In the representation according to FIG. 2, the reference numerals of FIG. 1 are the same for identical constructional parts. In FIG. 2, there can be seen that the leaf spring 9 is secured in horizontal direction by the screwedly mounted wedge-shaped plates 13. In FIG. 2, there are further indicated cams 18, which provide the possibility to secure the strap 5 and the rail 1 in cooperation with screws 12 which extend through the web of the rail 1 as well as through the strap 5.

Figure 3:
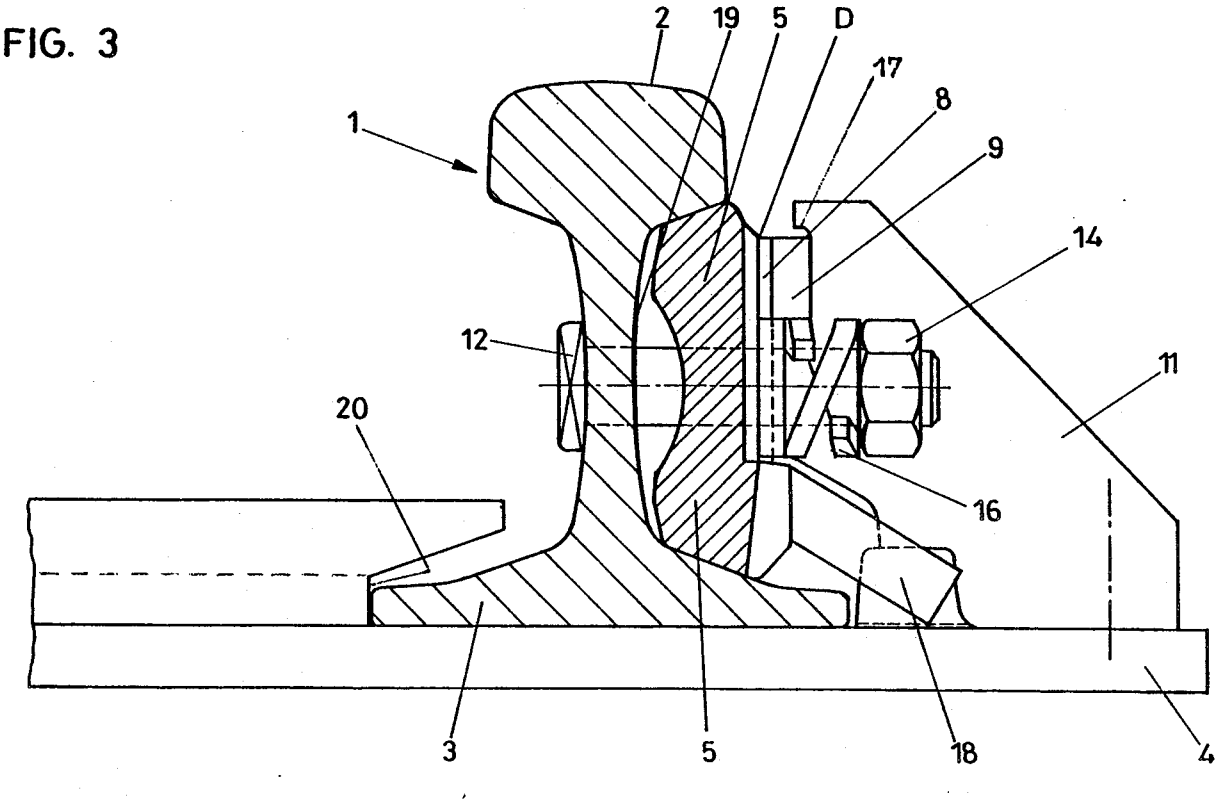
FIG. 3 shows a section along the lines III—III of FIG. 1 and 2.

From FIG. 3, it becomes clear that the strap or fishplate 5 is arranged within the fishplate seating 19 of the rail 1. In FIG. 3, there is further provided an abutment 20 being arranged on that side of the rail which is facing the running edge and being connected with the ribbed plate 4. On account of giving the strap 5 a convex outer side it becomes, in combination with a suitable number of fill plates providing for a defined pressure point D cooperating with the leaf spring 9, possible to compensate any tolerances in the size of the fishplate seating 19 of the rail 1 and to maintain a permanent force-locking connection between the supporting block 11 and the leaf spring 9 supported therein, on the one hand, and the strap 5 arranged in the fishplate seating 19, on the other hand. The leaf spring 9 is secured in vertical direction by stops 17 provided on the supporting block 11.

Figure 4:
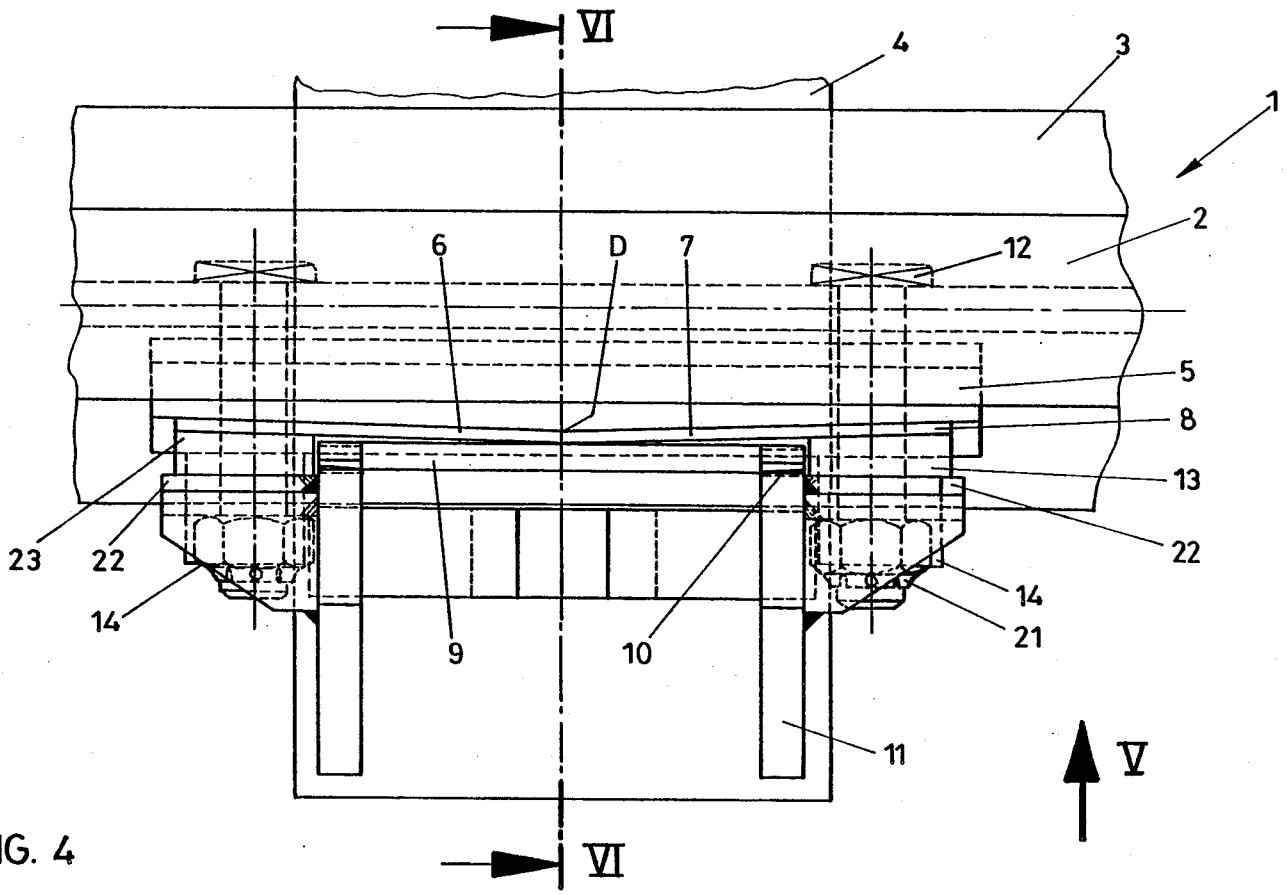
FIG. 4 shows in a view analogous to that of FIG. 1 a second embodiment of an arrangement according to the invention.
Figure 5:
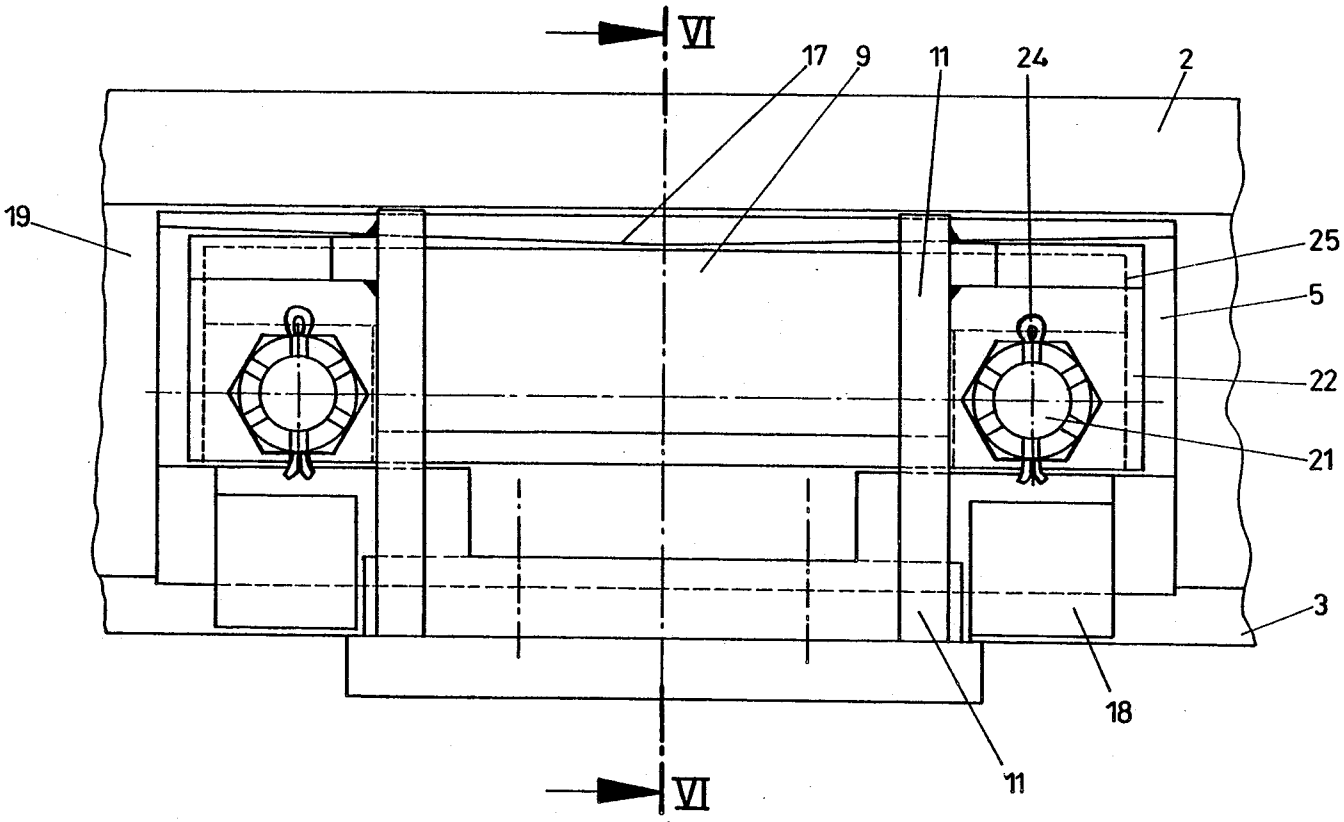
FIG. 5 shows analogous to FIG. 2 a view in direction of the arrow V of FIG. 4.
Figure 6:
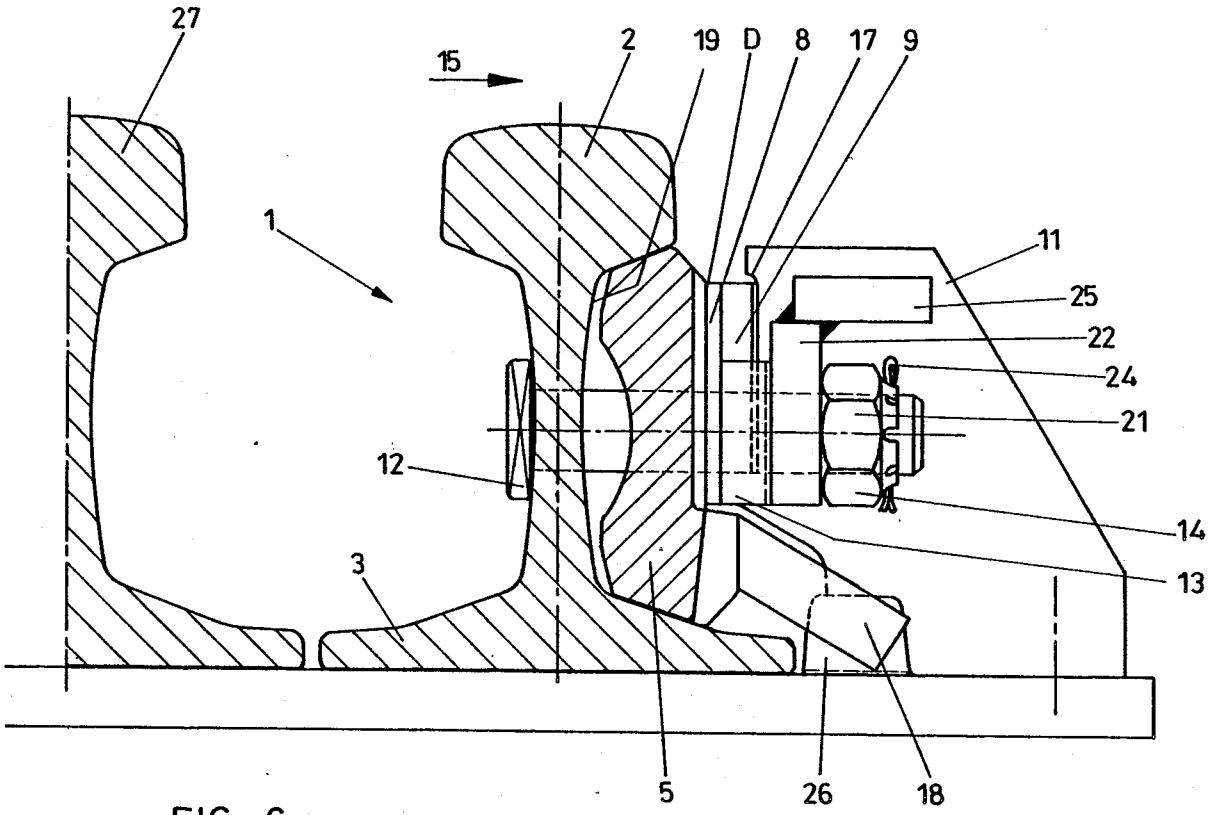
FIG. 6 shows a section along the lines VI—VI of FIGS. 4 and 5 and FIG. 7 shows in a view analogous to that of FIGS. 3 and 6 a further embodiment of an arrangement according to the invention.

In the second embodiment of the arrangement for securing the rail, which arrangement is shown in the FIGS. 4, 5 and 6, the strap 5 arranged within the fishplate seating has again a convex outer side comprising side surfaces 6 and 7 adjoining one another under a blunt or obtuse angle and defining a pressure point D cooperating, with interposition of fill plates 8, with the leaf spring 9 supported in the supporting block. In this embodiment, the nut 14 is secured by a crown nut 21 and by a splint, noting that, in the representation according to FIG. 4, the flange serving the purpose of screwing the rail with the supporting block 11 is designated by the reference numeral 22. The leaf spring 9 is secured in horizontal direction and in vertical direction in a manner analogous to that of the embodiment according to the FIGS. 1 to 3. The screw connection between the rail 1 with the supporting block 11 via the strap 5 and the fill plates 8, serves, in this case, the purpose of pre-tensioning the leaf spring 9 and of securing its position.

In FIG. 5, the splint of the crown nut 21 is designated by the reference numeral 24. In FIG. 5, there is further shown a stiffening rib 25 which is connected by welding with the supporting block 11 and with the flange 22, through which extends the screw mount.

It becomes clear from FIG. 6 that in the course of a movement of the rail in direction of the arrow 15 the rail foot 3 comes, for the purpose of avoiding overload of the leaf spring 9, into engagement with stops being connected with the supporting block 11 or being integrally formed thereon, so that further evading movement is no more possible on account of this rigid abutment. In this embodiment, a stop member on the inner side of the rail is not necessary at that side of the rail foot 3 which is averted from the supporting block 11. Such an arrangement is particularly suitable for the switch area as is indicated by an immediately adjacent further rail 27, noting that no space is at disposal for fastening means or stops, respectively, at the inner side of the rail.

Figure 7:
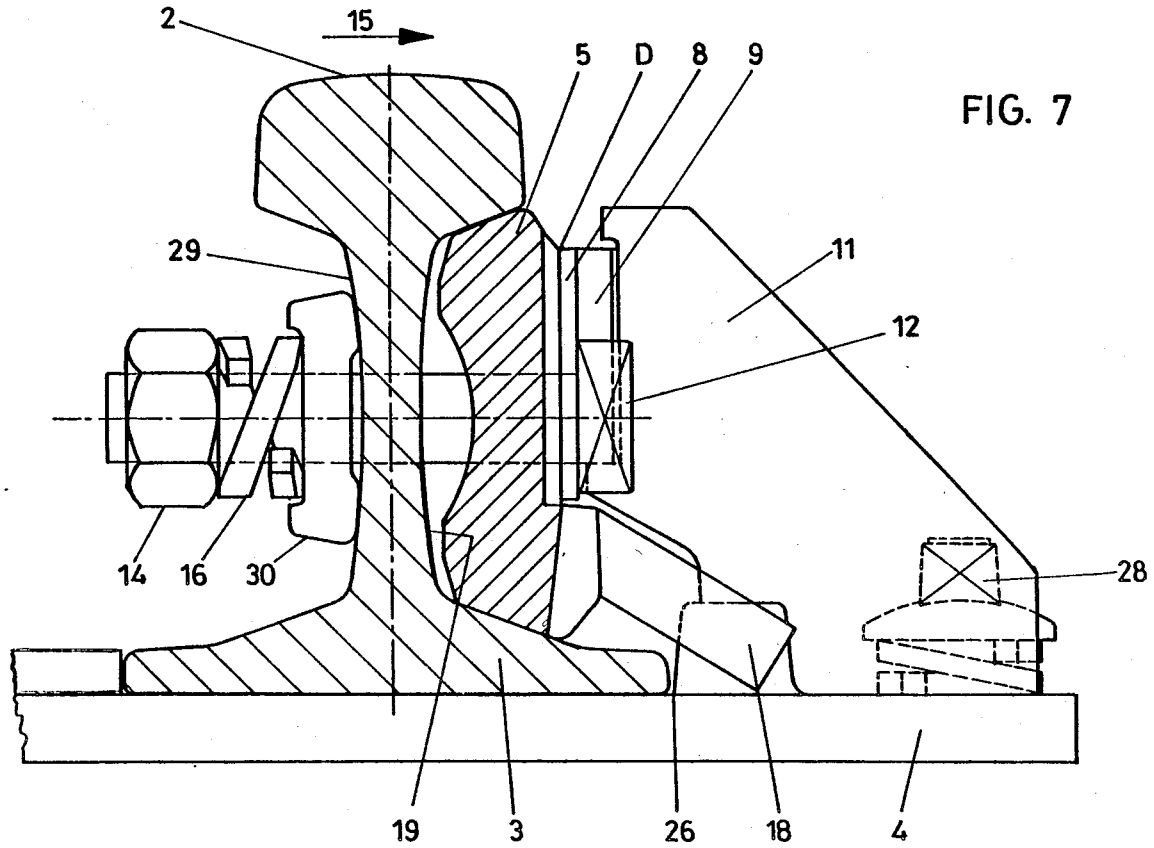

In the embodiment shown in FIG. 7, the supporting block 11 is connected with the ribbed plate 4 by means of screws 28. Fastening of the rail on the supporting block 11 is again effected by a screw mount 12, noting that there is again provided a spring ring 16 for securing the nut 14 against becoming loosened. In this embodiment, the nut 14 is arranged at the side facing the running edge, noting that an insert plate 30 is arranged between the rail web 29 and the spring ring 16 for uniformily introducing the acting forces. Supporting of the strap on the supporting block 11 is again effected with interposition of a leaf spring 9, which provides for a limited elastic shiftability of the rail in outward direction and in direction of the arrow 15, noting that this shifting path is again limited by stops 26 being connected with the supporting block 11.

In general, the leaf spring 9 is designed such that its length is smaller than the extension of the strap 5 in longitudinal direction of the rail. Of course, also a spring pile can be used in place of a single leaf spring.

What is claimed is:

1. An arrangement for fastening a rail of the type having a running surface and a rail foot interconnected by a web and wherein the running surface has a running edge at one side thereof, the fastening arrangement comprising a strap pressed against said web at a location adjacent the edge of the running surface opposite the running edge, said strap being urged towards the web by leaf spring means positioned on the opposite side of the strap from said web and engaging a convex surface of the strap.

2. An arrangement as set forth in claim 1, wherein said convex surface is formed by two surfaces of the strap intersecting at an obtuse angle.

3. An arrangement as set forth in claim 1 or 2, wherein the leaf spring means is supported within a supporting block, said block including means for preventing vertical movement of the spring means within the block.

4. An arrangement as set forth in claim 3, wherein the length of the leaf spring means is less than that of the strap and wherein the strap is connected with the rail web and with the supporting block by securing means which pass through the web, the strap and through lateral flanges provided in the supporting block, and which permit play in the strap.

5. An arrangement as set forth in claim 4, further comprising wedge-shaped plates interposed between said flanges and through which said securing means pass, said wedge-shaped plates forming stops against horizontal shifting movement of the leaf spring means.

6. An arrangement as set forth in claim 1 or 2, further comprising fill plates arranged between the strap and said leaf spring means.

7. An arrangement as set forth in claim 1 or 2, wherein the leaf spring means is supported within a support block, the arrangement further comprising cam means operatively connected with the strap and with stops provided on the support block to limit displacement of the rail towards the support block.

* * * * *